United States Patent [19]

Cole et al.

[11] Patent Number: 4,997,024

[45] Date of Patent: Mar. 5, 1991

[54] METHOD OF MAKING A PISTON

[75] Inventors: Andrew T. Cole, Bilton; Robert Munro, Lymington, both of England

[73] Assignees: T&N Technology Limited, Rugby; Wellworthy Limited, Lymington, both of United Kingdom; a part interest

[21] Appl. No.: 375,988

[22] Filed: Jul. 6, 1989

[30] Foreign Application Priority Data

Jul. 30, 1988 [GB] United Kingdom ..... 8818214

[51] Int. Cl.[5] ..... B22D 19/00

[52] U.S. Cl. ..... 164/75; 29/888.047; 29/888.048; 29/527.3; 164/98; 164/103; 164/120; 427/37

[58] Field of Search ..... 164/98, 75, 103, 104, 164/120; 427/34, 423, 327, 328, 37; 29/156.5 R, 527.3, 888.047, 888.048; 148/3

[56] References Cited

U.S. PATENT DOCUMENTS

| | | | |
|---|---|---|---|
| 2,123,181 | 7/1938 | Deputy | 164/75 |
| 2,453,772 | 11/1948 | Whitfield et al. | 164/75 |
| 4,008,052 | 2/1977 | Vishnevsky et al. | 164/75 |
| 4,334,507 | 6/1982 | Köhnert et al. | 29/156.6 R |
| 4,651,631 | 3/1987 | Avezou | 164/98 |
| 4,735,128 | 4/1988 | Mahrus et al. | 29/156.5 R |
| 4,849,247 | 7/1989 | Scanlon et al. | 427/34 |

FOREIGN PATENT DOCUMENTS

| | | |
|---|---|---|
| 0109814 | 5/1984 | European Pat. Off. . |
| 0528777 | 11/1940 | United Kingdom . |
| 0775595 | 5/1957 | United Kingdom . |
| 0892770 | 3/1962 | United Kingdom . |
| 0972046 | 10/1964 | United Kingdom . |

*Primary Examiner*—P. W. Echols
*Assistant Examiner*—I. Cuda
*Attorney, Agent, or Firm*—William R. Hinds

[57] ABSTRACT

A method of bonding a component in a piston, involves the steps of coating the component surfaces to be bonded with an oxidation-resistant particulate material, preheating the coated component, placing the preheated component in a casting die and then casting an aluminum alloy around the component. The casting technique may comprise squeeze-casting.

11 Claims, No Drawings

METHOD OF MAKING A PISTON

The present invention relates to pistons comprising aluminium-based alloys for internal combustion engines and particularly to such pistons having components of different metals therein.

Components such as ferrous inserts employed to enhance the wear characteristics of piston ring grooves, for example, are often incorporated by use of the well-known Alfin (trade mark) process.

The Alfin process is used in the manufacture of pistons by gravity casting and also by pressure casting methods such as squeeze casting, for example. Several problems can occur with the Alfin process and which can produce unsatisfactory bonds between the insert and the piston alloy. Such problems may include dirty or oxidised insert material, incorrect process conditions giving irregular intermetallic layer thickness and oxide dragged from the melt and entrained in the insert intermetallic surface coating. Furthermore, the Alfin process is not amenable to automation, operator skill being essential in the successful operation of the process.

Even where the bond is not degraded by any of the above defects it is still relatively weak and brittle and may fracture during heat treatment or machining of the piston.

Pistons produced by pressure casting techniques are often intended for the highest rated engines and the aluminium alloy of which they are made is frequently heat treated to optimize the material properties. Heat treatments commonly used include a solution treatment and quenching operation often followed by a precipitation treatment. The solution treatment causes the thickness of the brittle iron-aluminium intermetallic layer to increase by diffusion and become even weaker whilst the thermal shock of the quenching operation either weakens the bond still further or may destroy it altogether. If the bond does not fail during quenching it can fail due to the stresses generated during subsequent heat treatment or machining.

Kohnert et al in U.S. Pat. No. 4,334,507 describe a porous insert formed of a porous material and which is impregnated with piston alloy by a pressure casting technique. A problem with this approach is that particles of the material from which the insert is produced may be loosened during machining and become dislodged in service leading to increased wear and damage.

A method has now been discovered of bonding a component in a piston which overcomes the above disadvantages.

According to the present invention a method of making a piston having at least one component bonded therein selected from the group consisting of piston ring carrier, gudgeon pin boss bushes, combustion chamber bowl and piston crown, comprises the steps of coating the component surface to be bonded with a layer of a particulate, oxidation resistant material by a physical vapor deposition technique, preheating the coated component, placing the preheated component in a piston casting die, and then casting an aluminum alloy around the component by a pressure casting technique.

The component should be in a clean, non-oxidised condition to allow coating with the particulate material. The particulate material may be deposited by a technique such as plasma, arc, flame spraying or other physical vapour deposition process, for example.

Preferably, the coating thickness may lie in the range 0.025 to 0.3 mm and more preferably in the range from 0.05 to 0.15 mm in thickness.

Preferably, the particulate material should be substantially oxidation-resistant at least up to the preheating temperature prior to casting of the aluminium alloy. Suitable materials may include austenitic stainless steels, nickel-based alloys, copper-based alloys and in some circumstances, ferritic stainless steel.

Preferably the pressure casting technique is squeeze casting, for example.

The component may be first coated with a tin layer by dipping or electro plating, for example, to enhance the bonding of the subsequent coating during a subsequent heat treatment prior to casting.

The coated component may also undergo a preliminary heat treatment to enhance the bond between the coating and the component prior to casting.

For some components such as ferrous crowns the particulate material may also comprise ceramic material which also affords some thermal barrier properties.

Components bonded to or into pistons in this manner do not need first to be dipped in molten aluminium as with the Alfin process. Therefore, no initial brittle layer of aluminium-iron intermetallic compound is formed.

It is considered that the method of the present invention will permit heat treatments which allow the optimum properties of the aluminium alloy to be developed and which is not possible with current methods.

In order that the present invention may be more fully understood examples will now be described by way of illustration only.

A piston ring carrier insert of Ni-Resist (trade mark) iron was cleaned by abrasive grit blasting and coated by plasma spraying with 0.12 mm thick layer of 316L stainless steel powder. The coated ring carrier was then preheated to 400° C. prior to placing in the female portion of a squeeze casting die. Lo-ex (trade mark) aluminium piston alloy at 740° to 760° C. was then squeeze cast around the insert. The squeeze-casting pressure of 7 to 10 tsi was maintained until complete solidification had taken place.

Samples were taken from the cast piston which gave tensile strengths for the bond having a mean of 126.5 MPa. This gave an 80% strength increase over a typical Alfin bond as formed without any further heat treatment.

Other samples were prepared by the same method but having different sprayed layer thicknesses. The strengths of the interfaces were tested and gave the results shown in the Table below.

| Sprayed Layer Thickness (mm) | UTS (MPa) |
|---|---|
| 0.025 | 126.8 |
| 0.025 | 119.0 |
| 0.05 | 124.3 |
| 0.05 | 148.5 |
| 0.10 | 120.9 |
| 0.10 | 152.5 |
| 0.20 | 130.8 |
| 0.20 | 117.8 |
| 0.30 | 102.9 |
| 0.30 | 130.2 |

We claim:

1. A method of making a piston having at least one component bonded therein selected from the group consisting of piston ring carrier, gudgeon pin boss bushes, combustion chamber bowl and piston crown, the method comprising the steps of coating the component surface to be bonded with a layer of a particulate, oxidation resistant material by a physical vapour deposition technique, preheating the said at least one component, placing said preheated at least one component in a piston casting die and then casting an aluminium alloy around said at least one component by a pressure casting technique.

2. A method according to claim 1 wherein said physical vapour deposition technique is selected from the group consisting of plasma, arc and flame spraying.

3. A method according to claim 1 wherein said particulate material is oxidation resistant at least up to a desired preheating temperature.

4. A method according to claim 1 wherein said particulate material is chosen from the group consisting of steels, stainless steels, nickel-based alloys and copper-based alloys.

5. A method according to claim 1 wherein said pressure casting technique is squeeze-casting.

6. A method according to claim 4 wherein said material is 316L stainless steel powder.

7. A method according to claim 1 wherein said layer is between 0.025 and 0.3 mm thick.

8. A method according to claim 7 wherein said layer is between 0.05 to 0.15 mm thick.

9. A method according to claim 6 wherein said layer is between 0.025 and 0.3 mm thick.

10. A method according to claim 1 wherein said at least one coated component is heat treated prior to the preheating step.

11. A method according to claim 1 wherein said piston is heat treated subsequently to solidification after casting.

* * * * *